US005210010A

United States Patent [19]

Fielding

[11] Patent Number: 5,210,010

[45] Date of Patent: May 11, 1993

[54] SILVER HALIDE DEVELOPING SOLUTIONS

[75] Inventor: Ross Fielding, Knutsford Cheshire, United Kingdom

[73] Assignee: Ilford Limited, Knutsford Cheshire, United Kingdom

[21] Appl. No.: 876,834

[22] Filed: Apr. 30, 1992

[30] Foreign Application Priority Data

May 15, 1991 [GB] United Kingdom ..... 9110482

[51] Int. Cl.[5] ..... G03C 5/30

[52] U.S. Cl. ..... 430/466; 430/438; 430/481; 430/482

[58] Field of Search ..... 430/466, 481, 482, 436, 430/437, 438, 439, 492, 491

[56] References Cited

U.S. PATENT DOCUMENTS

| | | | |
|---|---|---|---|
| 2,753,265 | 7/1956 | Kendall et al. | 430/466 |
| 3,178,284 | 4/1965 | John et al. | 430/466 |
| 4,987,060 | 1/1991 | Mardresano | 430/466 |
| 5,041,363 | 8/1991 | Sakuma | 430/481 |

FOREIGN PATENT DOCUMENTS

| | | | |
|---|---|---|---|
| 2934 | 10/1981 | World Int. Prop. O. | 430/466 |

*Primary Examiner*—Hoa Van Le
*Attorney, Agent, or Firm*—Darby & Darby

[57] ABSTRACT

There is described a concentrated developer solution which comprises from about 20 to about 60 g/l of dihydroxybenzene developing agent, preferably hydroquinone, from about 0.5 to about 3.0 g/l of an auxiliary developing agent, preferably 1-phenyl-3 pyrazolidinone, from about 300 to about 500 g/l of potassium sulphite and which is buffered to a pH of from about 8 to about 10 with a buffering agent other than an alkanolamine and which comprises sufficient organic solvent other than an alkanolamine to dissolve the hydroquinone.

Such a concentrated developing solution which contains a high concentration of potassium sulphite has when diluted a long useful life and produces images of low graininess.

12 Claims, No Drawings

SILVER HALIDE DEVELOPING SOLUTIONS

BACKGROUND OF THE INVENTION

This invention relates to silver halide material developing solutions.

There is a continuing need to provide new types of developing solutions as the commercial needs change. At the moment liquid concentrate developing solutions are finding greater favor than powder developers because they do not need dissolution and heating. That is to say, all the ingredients which are necessary to effect development of the exposed silver halide material are dissolved in an aqueous solution which is made as concentrated as possible. This solution is diluted with water to prepare a working strength solution.

Concentrated developing solutions are used in two ways. The first is as a single shot developer wherein the concentrated developing solution is diluted to the working strength developing solution and this solution is used once only. In this case the development is often carried out in a shallow dish or in a small spiral tank.

The other mode of use for concentrated liquid developing solutions is in deep-tank processing wherein the exposed photographic material is fed into and out of the tank. The concentrated developing solution is diluted to the correct strength either in or outside the tank with the requisite amount of water. An important requirement of this developing solution in the diluted form is that it should remain active over a long period. Often the activity of the developing solution in such tanks is maintained by the addition of some of the working strength developing solution, in such an amount so as to at least maintain the volume of the bath preferably in excess of this amount so as to maintain both the volume and the activity of the bath.

To provide a developing solution with a long life which yields developed image of low graininess, it is necessary to incorporate in the concentrated solution as much sulphite as possible.

In the past this has been achieved by the presence in the solution of an alkanolamine which is able to complex a large amount of sulphite as an alkanolamine sulphite/water mixed solution. Alkanolamines in the presence of sulphite form either alkanolamine sulphite or bisulphite. Diethanolamine (DEA) is a widely used alkanolamine. However, diethanolamine sulphite or bisulphite has a very high viscosity and it has been found difficult to formulate concentrated developers having a sufficiently high sulphite content. Further, alkanolamines and in particular diethanolamine tend to accelerate the process of chemical development. This causes a build-up of image density with a reduced contribution from physical development. This tends to produce an image which is more grainy than an image obtained in the absence of an alkanolamine.

Thus it is the object of the present invention to provide a liquid concentrate developer which when diluted has a long useful life but which produces developed images of low graininess.

SUMMARY OF THE INVENTION

Therefore, according to the present invention, there is provided a concentrated developer solution which comprises from about 20 to about 60 g/l of a dihydroxybenzene, preferably hydroquinone, from about 0.5 to about 3.0 g/l of an auxiliary developing agent such as a 1-phenyl-3-pyrazolidinone, from about 300 to about 500 g/l of potassium sulphite and which is buffered to a pH of from 8 to 10 with a buffering agent other than an alkanolamine and which comprises sufficient organic solvent other than an alkanolamine to dissolve the dihydroxybenzene.

The preferred range of the dihydroxybenzene is from about 40 to about 50 g/l. Suitable dihydroxybenzenes include chlorohydroquinone, methylhydroquinone and gentisic acid without limitation.

The preferred range of the auxiliary developing agent is from about 0.5 to about 1.5 g/l.

Preferred auxiliary developing agents are 1-phenyl-3-pyrazolidinone developing agents which include compounds of the general formula I:

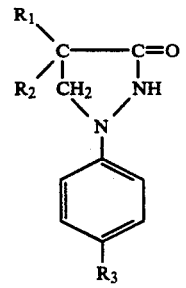

wherein $R_1$ is hydrogen, methyl or ethyl, $R_2$ is hydrogen, methyl or $—CH_2OH$ and $R_3$ is hydrogen, methyl or ethyl.

The most preferred auxiliary developing agent is a 1-phenyl-3-pyrazolidone wherein $R_1$, $R_2$ and $R_3$ are all hydrogen and the compound wherein $R_1$ is methyl, $R_2$ is $—CH_2OH$ and $R_3$ is hydrogen. Other useful auxiliary developing agents are para-aminophenols, such as metal.

The preferred buffering agent to maintain the required pH is borax.

The preferred organic solvent to dissolve the dihydroxybenzene is a glycol for example diethylene glycol (digol), ethylene glycol or triethylene glycol. The solvent for the dihydroxybenzene helps to prevent precipitation of the dihydroxybenzene at low temperature.

Preferably a sequestering agent is present in the concentrated developing solution to sequester calcium, magnesium and iron and prevent these forming sludges and precipitation in the diluted solution when in the developing tank.

The preferred sequestering agent is diethylene-triamine -pentaacetic acid (DTPA). Other useful sequestering agents are Ethylene diamine tetraacetic acid (EDTA) and 1,3-diamino-2-propanol-tetraacetic acid (DAPTA).

The preferred amount of potassium sulphite for use in the developing solution is 300–400 g/l. If more is present the solution can become unstable under certain conditions, such as low temperature storage conditions wherein the sulphite can crystallize out.

It is an important feature of the present invention that essentially only potassium sulphite is used in the concentrated developer solution. Sodium sulphite is not water-soluble enough, and ammonium salts cannot be used in developing solution as they tend to cause fogging, and release the unpleasant odor of ammonia.

The concentrated developer solution of the present invention when diluted can be used to develop any exposed photographic material but its main use is to develop camera films in deep tanks wherein the films are fed mechanically into the tanks and out again.

The following Example will serve to illustrate the invention.

EXAMPLE

Two developer concentrates A and B were prepared

| | A | B |
|---|---|---|
| DEA $H_2SO_3$ (15% $SO_2$) | 980 g | — |
| Pot Sulphite (65% w/v) | — | 548 $cm^3$ |
| Water | 205 $cm^3$ | 380 $cm^3$ |
| Digol | — | 45 $cm^3$ |
| Hydroquinone | 44 g | 44 g |
| 1-phenyl-3-pyrazolidone | 1.2 g | 1.2 g |
| DAPTA | 4.8 g | 4.8 g |
| Borax | — | 23.5 g |

Thus developer A comprises diethanolamine (DEA) sulphite and is the comparison developer whilst developer B comprises no alkanolamine and is a developer according to the present invention.

The 1-phenyl-3-pyrazolidinone used in both developers was 4-hydroxymethyl-4-methyl-1-phenyl-3-pyrazolidinone. Both developers had a pH at 25° C. of 8.5 when diluted 1+4.

Both developers were diluted 1 to 4 with water to yield a working strength developing solution.

Both solutions were used in an automatic processing machine in which the film was fed in and out automatically, first into the developing solution, then into a fixing solution then into a water-washing solution.

Lengths of the same 35 mm high speed camera film were exposed and processed in the two developing solutions for the same period of time. That is to say, each film was in the developing section for about 5 minutes.

The sensitometric characteristics of the films developed in solutions A and B were then compared.

The film in both developers was evaluated at a contrast of $G_{1.5}=0.62$.

The results were as follows:

| Sensitometric Results | Developer A | Developer B |
|---|---|---|
| Fog | 0.26 | 0.27 |
| Speed | 5.75 | 5.77 |
| Granularity | 34 | 3 |
| SGI (speed to grain index) | 300 | 400 |
| SGI = $(10^{SQ.1} \times G_{1.5})$ granularity | | |

These results show that the film developed in diluted developer B exhibited a significant reduction in granularity and an improvement in speed to grain index. Even a two-point improvement in granularity would be considered significant. A one-point improvement would also be significant if sufficient samples are tested.

The diluted developer B in the processing task was used over a period of a week. During this period the volume and activity of the developer was maintained by the addition to the bath of a volume of the fresh working strength developer solution.

Developers according to the invention have a working life of more than six months. Subsequently, the granularity improves but fog increases.

What is claimed is:

1. A concentrated developer solution which comprises from about 20 to about 60 g/l of a dihydroxybenzene, from about 0.5 to about 3.0 g/l of an auxiliary developing agent, from about 300 to about 500 g/l of potassium sulphite and which is buffered to a pH of from about 8 to about 10 with a buffering agent other than an alkanolamine and which comprises an organic solvent other than an alkanolamine sufficient to dissolve the dihydroxybenzene.

2. A concentrated developer solution according to claim 1 wherein said dihydroxybenzene is hydroquinone and said auxiliary developing agent is a 1-phenyl-3-pyrazolidone.

3. A concentrated developer solution according to claim 2 which comprises about 40 to about 50 g/l of hydroquinone.

4. A concentrated developer solution according to claim 2 which comprises from about 0.5 to about 1.5 g/l of the 1-phenyl-3-pyrazolidinone.

5. A concentrated developer solution according to claim 2 wherein the 1-phenyl-3-pyrazolidinone is 4-hydroxymethyl-4-methyl-1-phenyl-3-pyrazolidinone.

6. A concentrated developer solution according to claim 1 which comprises borax as buffering agent.

7. A concentrated developer solution according to claim 1 which comprises as the organic solvent digol.

8. A concentrated developer solution according to claim 1 which comprises from about 300 to about 400 g/l of potassium sulphite.

9. A concentrated developer solution according to claim 1 which also comprises a sequestering agent.

10. A concentrated developer solution according to claim 9 wherein the sequestering agent is DTPA.

11. The solution of claim 1 wherein said buffering agent comprises borax and said solvent comprises a member selected from the group consisting of digol, trigol and ethylene glycol.

12. The solution of claim 2 wherein said buffering agent comprises borax and said solvent comprises a member selected from the group consisting of digol, trigol and ethylene glycol.

* * * * *